US008814387B2

(12) United States Patent
Moon

(10) Patent No.: US 8,814,387 B2
(45) Date of Patent: Aug. 26, 2014

(54) LED BULB

(76) Inventor: Sang Pil Moon, Hong Kong (HK)

( * ) Notice: Subject to any disclaimer, the term of this patent is extended or adjusted under 35 U.S.C. 154(b) by 215 days.

(21) Appl. No.: 13/547,038

(22) Filed: Jul. 11, 2012

(65) Prior Publication Data

US 2014/0016312 A1 Jan. 16, 2014

(51) Int. Cl.
*F21S 4/00* (2006.01)

(52) U.S. Cl.
USPC ..... 362/249.02; 362/296.05

(58) Field of Classification Search
CPC ... F21V 29/004; F21V 29/2293; F21V 17/12; F21V 7/20; F21V 3/00; F21V 9/00
USPC ..... 362/373, 294, 249.01, 249.02, 249.06, 362/298, 296.05, 311.02, 311.06, 345, 363
See application file for complete search history.

(56) References Cited

U.S. PATENT DOCUMENTS

| | | | | |
|---|---|---|---|---|
| 2009/0195186 | A1* | 8/2009 | Guest et al. | 315/294 |
| 2012/0044684 | A1* | 2/2012 | Takahasi et al. | 362/249.01 |
| 2012/0051069 | A1* | 3/2012 | Lim | 362/373 |
| 2013/0148364 | A1* | 6/2013 | Osawa | 362/373 |
| 2013/0170231 | A1* | 7/2013 | Chiu | 362/363 |

* cited by examiner

*Primary Examiner* — Julie Bannan

(57) ABSTRACT

The present invention directs a LED bulb. The LED bulb, including: a stand, a end of which being shaped of thread, and a driver which is sleeved in inner chamber of the stand, a lamp housing which comprises a T-like top portion and a bottom portion is arranged on the stand; a sleeve is located on the bottom portion of lamp housing; a pedestal is formed by the top portion of lamp housing which is stretched protuberantly along radial direction as a rotating track of a cone, a ring-shape groove is formed on the pedestal to communicate with a inner chamber of bottom portion of the lamp housing in the concentric circle direction and make a inner portion of a lampshade communicated with the outside, a tube formed on top portion of the lamp housing in the center thereof is communicated with the bottom portion of lamp housing.

9 Claims, 1 Drawing Sheet

LED BULB

FIELD OF THE INVENTION

The present invention relates to a LED bulb.

BACKGROUND OF THE INVENTION

Conventional LED bulb only has the upward irradiating light without the downward irradiating light. When it is used in the table lamp, the intensity of illumination is obviously not enough.

SUMMARY OF THE INVENTION

One object of the present invention is to provide a LED bulb which arranged PCB board and aluminum block with ring-shape LED lights at the two surfaces of aluminum block, and heat produced by LED lights is discharged through PCB board, aluminum substrate and aluminum block via lamp housing. Another object of the present invention is to provide the a LED bulb within arrangement of downward irradiating LED lights which matching with refracting of the reflector, which is appropriate for large range irradiating angle of 320 degree and has the high utilization of light source.

To achieve the above-mentioned objects, the technical solution of the present invention is to provide a LED bulb, including: a stand, a end of which being shaped of thread, and a driver which is sleeved in inner chamber of the stand, a lamp housing which includes a T-like top portion and a bottom portion is arranged on the stand; a sleeve is located on the bottom portion of lamp housing and sleeved on the stand; a pedestal is formed by the top portion of lamp housing which is stretched protuberantly along the radial direction as a rotating track of a cone, a ring-shape groove is formed on the pedestal to communicate with a inner chamber of the bottom portion of the lamp housing in the concentric circle direction and make a inner portion of a lampshade being communicated with the outside, a tube formed on the top portion of the lamp housing in the center thereof is communicated with the bottom portion of lamp housing, a caliber of the tube is smaller than the sleeve at the bottom portion of the lamp housing; and the lampshade is arranged on the top portion of the lamp housing and a opening of the lampshade is mounted in the ring-shape groove, a T-like LED assembly is mounted in the tube of the top portion of lamp housing and the head thereof is laid outside of the opening.

Preferably, the LED assembly includes an upper cone-shape aluminum block, a lower cylinder-shape aluminum block which is integrated with the upper cone-shape aluminum block and the diameter thereof is shrinking, an upper PCB board which is arranged on an upper surface of the upper cone-shape aluminum block and has ring-shape LED lights arranged thereon, a lower PCB board which is covered on a lower surface of the upper cone-shape aluminum block and has ring-shape LED lights arranged thereon, a line hole along the circle center is respectively passed through the upper PCB board, the upper cone-shape aluminum block and lower cylinder-shape aluminum block, a support which is mounted in line holes of the upper PCB LED board, the upper cone-shape aluminum block and the lower cylinder-shape aluminum block along the center line of said line holes to connect the stand and driver to the LED assembly through a fastening way, a through-hole which is symmetrically formed on both sides of the line hole and through the upper PCB board, the upper cone-shape aluminum block and the lower PCB board, and a line tube which is respectively sleeved in said through-hole and mounted on the upper PCB board and the lower PCB board; a leading wire of the driver is passed through the through-hole to connect with electric pads of the upper PCB board; the LED lights on the upper PCB board and the lower PCB board are respectively received electricity from the upper PCB board and the lower PCB board.

Preferably, an installed slot which is communicated with the inner chamber of a lamp housing stand is formed in said pedestal corresponding to the through-hole.

Preferably, the line hole of the lower cylinder-shape aluminum block is reamed to be a conical bore.

Preferably, the support includes a tube which is sleeved in the line hole, a cone flame which is located in the conical bore of lower cylinder-shape aluminum block, a casing which is molded by the cone flame expanding along the radial direction and used for sleeving a top end of the driver.

Preferably, an outer fastener is arranged on the opening of the lampshade, an inner slot is arranged on the inner side of the ring-shape groove of the lamp housing, the outer fastener of the opening is snapped into the inner slot of ring-shape groove of the lamp housing.

Preferably, a cone outer wall of pedestal from the lower LED board to the ring-shape groove concaved on the pedestal is mounted on a reflector which is coincided with the shape of cone outer wall of pedestal, the end of reflector is bent perpendicularly to locate between the opening of the lampshade and the bottom of the ring-shape groove of the pedestal.

Preferably, heat from the LED lights which are arranged on the upper PCB board and the lower PCB board is transferred to the lamp housing through the upper cone-shape aluminum block and the lower cylinder-shape aluminum block, and discharged outside via heat sinks which are protrudingly arranged on outer wall of the lamp housing.

Another technical solution of the present invention is to provide a LED bulb, including: a stand, a end of which being shaped of thread, and a driver which is sleeved in inner chamber of the stand, a lamp housing which includes a T-like top portion and a bottom portion is arranged on the stand; a sleeve is located on the bottom portion of lamp housing and sleeved on the stand; a pedestal is formed by the top portion of lamp housing which is stretched protuberantly along the radial direction as a rotating track of a cone, a hole is formed on the pedestal to communicate with a inner chamber of the bottom portion of the lamp housing in the concentric circle direction and make a inner portion of a lampshade being communicated with the outside, a tube formed on the top portion of the lamp housing in the center thereof is communicated with the bottom portion of lamp housing, a caliber of the tube is smaller than the sleeve at the bottom portion of the lamp housing; and the lampshade is arranged on the top portion of the lamp housing and a opening of the lampshade is mounted in the ring-shape groove, a T-like LED assembly is mounted in the tube of the top portion of lamp housing and the head thereof is laid outside of the opening; the LED assembly includes an upper cone-shape aluminum block, a lower cylinder-shape aluminum block which is integrated with the upper cone-shape aluminum block and the diameter thereof is shrinking, an upper PCB board which is arranged on an upper surface of the upper cone-shape aluminum block and has ring-shape LED lights arranged thereon, a lower PCB board which is covered on a lower surface of the upper cone-shape aluminum block and has ring-shape LED lights arranged thereon, a line hole along the circle center respectively is passed through the upper PCB board, the upper cone-shape aluminum block and lower cylinder-shape aluminum block, a support which is mounted in line holes of the upper PCB LED board, the upper cone-shape aluminum block and the lower cylinder-shape aluminum block along the center line of said line holes to connect the stand and driver to the LED assembly through a fastening way, a through-hole which is symmetrically formed on both sides of the line hole and through the upper PCB board, the upper cone-shape aluminum block and the lower PCB board, and a line tube which is respectively sleeved in said through-hole and mounted on the upper PCB board and the lower PCB board; a leading wire of the driver is passed through the through-hole to connect with electric pads of the upper PCB board; the LED lights on the upper PCB board and the lower PCB board are respectively received electricity from the upper PCB board and the lower PCB board; an installed slot which is communicated with the inner chamber of a lamp housing stand is formed in said pedestal corresponding to the through-hole; the line hole of the lower cylinder-shape aluminum block is reamed to be a conical bore; the support includes a tube which is sleeved in the line hole, a cone flame which is located in the conical bore of lower cylinder-shape aluminum block, a casing which is molded by the cone flame expanding along the radial direction and used for sleeving a top end of the driver; an outer fastener is arranged on the opening of the lampshade, an inner slot is arranged on the inner side of the ring-shape groove of the lamp housing, the outer fastener of the opening is snapped into the inner slot of ring-shape groove of the lamp housing; a cone outer wall of pedestal from the lower LED board to the ring-shape groove concaved on the pedestal is mounted on a reflector which is coincided with the shape of cone outer wall of pedestal, the end of reflector is bent perpendicularly to locate between the opening of the lampshade and the bottom of the ring-shape groove of the pedestal; heat from the LED lights which are arranged on the upper PCB board and the lower PCB board is transferred to the lamp housing through the upper cone-shape aluminum block and the lower cylinder-shape aluminum block, and discharged outside via heat sinks which are protrudingly arranged on outer wall of the lamp housing.

Compared to the prior art, the advantages of the present invention as following:

(1) The efficiency of heat discharging is very high in the present invention, which has a large range of irradiance angle (larger than 280 degree) and high utilization of light source. It is very useful for the application of table lamp, and also has a long service life.

(2) The light from the LED lights arranged on the PCB board in this LED bulb irradiate as ordinary bulb rays, but the light from the LED lights arranged on the aluminum substrate partly irradiate downward, and the other part of light refracts via the reflector which irradiating along the connection of the above two parts rays. It achieves a seamless illuminate of large aperture and high utilization of light source.

BRIEF DESCRIPTION OF THE DRAWINGS

The accompanying drawings facilitate an understanding of the various embodiments of this invention. In such drawings.

DETAILED DESCRIPTION OF ILLUSTRATED EMBODIMENTS

Figure 1:
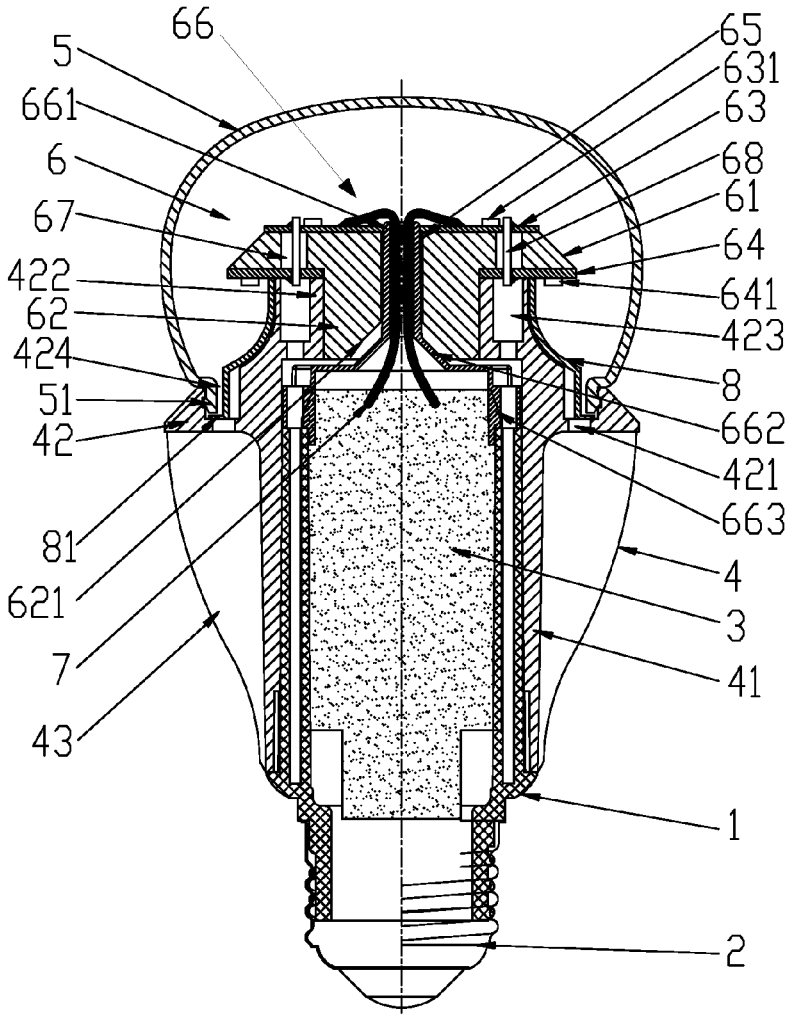
FIG. 1 is a cut-away view of the LED bulb of the present invention.

Various preferred embodiments of the invention will now be described with reference to the figures, wherein like reference numerals designate similar parts throughout the various views.

Figure 2:
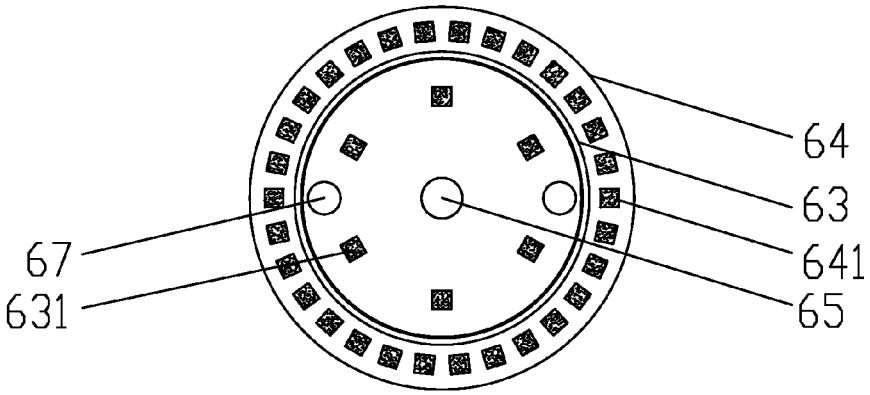
FIG. 2 is a top view of LED bulb in FIG. 1.

Referring to FIG. 1 and FIG. 2, in this embodiment of the present invention, a LED bulb, including: a stand 1, a end 2 of which being shaped of thread, and a driver 3 which is sleeved in inner chamber of the stand, a lamp housing 4 which includes a T-like top portion and a bottom portion is arranged on the stand; a sleeve 41 is located on the bottom portion of lamp housing and sleeved on the stand 1; a pedestal 42 is formed by the top portion of lamp housing 4 which is stretched protuberantly along the radial direction as a rotating track of a cone, a hole 421 is formed on the pedestal 42 to communicate with a inner chamber of the bottom portion of the lamp housing 4 in the concentric circle direction and make a inner portion of a lampshade 5 being communicated with the outside, a tube 422 formed on the top portion of the lamp housing 4 in the center thereof is communicated with the bottom portion of sleeve 41, a caliber of the tube 422 is smaller than the sleeve 41 at the bottom portion of the lamp housing; and the lampshade 5 is arranged on the top portion of the lamp housing 4 and a opening 51 of the lampshade is mounted in the ring-shape groove 424, a T-like LED assembly 6 is mounted in the tube 422 of the top portion of lamp housing and the head thereof is laid outside of the opening.

In this embodiment, the LED assembly 6 includes an upper cone-shape aluminum block 61, a lower cylinder-shape aluminum block 62 which is integrated with the upper cone-shape aluminum block 61 and the diameter thereof is shrinking, an upper PCB board 63 which is arranged on an upper surface of the upper cone-shape aluminum block 61 and has ring-shape LED lights 631 arranged thereon, a lower PCB board 64 which is covered on a lower surface of the upper cone-shape aluminum block 61 and has ring-shape LED lights 641 arranged thereon, a line hole 65 is respectively along the circle center pass through the upper PCB board 63, the upper cone-shape aluminum block 61 and lower cylinder-shape aluminum block 62, a support 66 which is mounted in line holes 65 along the center line of said line holes to connect the stand 1 and driver 3 to the LED assembly 6 through a fastening way, a through-hole 67 which is symmetrically formed on both sides of the line hole 65 and through the upper PCB board 63, the upper cone-shape aluminum block 61 and the lower PCB board 64, and a line tube 68 which is respectively sleeved in said through-hole 67 and mounted on the upper PCB board 63 and the lower PCB board 64; a leading wire 7 of the driver 3 is passed through the through-hole 67 to connect with electric pads of the upper PCB board 63; the LED lights 631 on the upper PCB board 63 and the LED lights 641 on the lower PCB board 64 are respectively received electricity from the upper PCB board and the lower PCB board.

In this embodiment, an installed hole 423 which is communicated with the inner chamber of a lamp housing stand 1 is formed in said pedestal 42 corresponding to the through-hole 67.

In this embodiment, the line hole of the lower cylinder-shape aluminum block 62 is reamed to be a conical bore 621.

In this embodiment, the support 66 includes a tube 661 which is sleeved in the line hole 65, a cone flame 662 which is located in the conical bore 621 of lower cylinder-shape aluminum block, a casing 663 which is molded by the cone flame 662 expanding along the radial direction and used for sleeving a top end of the driver 3.

In this embodiment, an outer fastener is arranged on the opening 51 of the lampshade, an inner slot is arranged on the inner side of the ring-shape groove 424 of the lamp housing, the outer fastener of the opening 51 is snapped into the inner slot of ring-shape groove 424 of the lamp housing.

In this embodiment, a cone outer wall of pedestal 42 from the lower PCB board to the ring-shape groove 424 concaved on the pedestal is mounted on a reflector 8 which is coincided with the shape of cone outer wall of pedestal, the end 81 of reflector 8 is bent perpendicularly to locate between the opening 51 of the lampshade and the bottom of the ring-shape groove 424 of the stand.

In this embodiment, heat from the LED lights 631 and 641 which are arranged on the upper PCB board 63 and the lower PCB board 64 is transferred to the lamp housing 4 through the upper cone-shape aluminum block 61 and the lower cylinder-shape aluminum block 62, and discharged outside via heat sinks 43 which are protrudingly arranged on outer wall of the lamp housing 4.

In this embodiment, the light from the LED lights 631 arranged on the upper PCB board in this LED bulb irradiate as ordinary bulb rays, but the light from the LED lights 641 arranged on the lower PCB board partly irradiates downward, and the other part of light reflect via the reflector 8 which irradiating along the connection of the above two parts rays. It achieves a seamless illuminate of large aperture and high utilization of light source.

While the invention has been described in connection with what are presently considered to be the most practical and preferred embodiments, it is to be understood that the invention is not to be limited to the disclosed embodiments, but on the contrary, is intended to cover various modifications and equivalent arrangements included within the spirit and scope of the invention.

What is claimed is:

1. A LED bulb, comprising: a stand, wherein an end of the stand is shaped with a thread, and a driver which is sleeved in an inner chamber of the stand, a lamp housing which comprises a T-like top portion and a bottom portion being arranged on the stand; wherein a sleeve is located on the bottom portion of lamp housing and sleeved on the stand; and a pedestal is formed by the top portion of lamp housing which is stretched protuberantly along the radial direction as a rotating track of a cone, wherein the pedestal includes a ring-shape groove formed to communicate with an inner chamber of the bottom portion of the lamp housing in the concentric circle direction and to make an inner portion of a lampshade communicated with the outside, wherein a tube is formed on the top portion of the lamp housing in the center thereof and is communicated with the bottom portion of lamp housing, a caliber of the tube is smaller than the sleeve at the bottom portion of the lamp housing; and the lampshade is arranged on the top portion of the lamp housing and an opening of the lampshade is mounted in the ring-shape groove, wherein a T-like LED assembly is mounted in the tube of the top portion of lamp housing and the T-like LED assembly having a head that extends through the opening.

2. A LED bulb according to claim 1, wherein said LED assembly comprises an upper cone-shape aluminum block, a lower cylinder-shape aluminum block which is integrated with the upper cone-shape aluminum block and the diameter of the aluminum block being reduced, an upper PCB board which is arranged on an upper surface of the upper cone-shape aluminum block and has ring-shape LED lights arranged thereon, a lower PCB board which is covered on a lower surface of the upper cone-shape aluminum block and has ring-shape LED lights arranged thereon, a line hole along the circle center is respectively passed through the upper PCB board, the upper cone-shape aluminum block and lower cylinder-shape aluminum block, a support which is mounted in said line hole of the upper PCB LED board, the upper cone-shape aluminum block and the lower cylinder-shape aluminum block along the center line of said line hole to connect the stand and driver to the LED assembly through a fastening way, a through-hole which is symmetrically formed on both sides of the line hole and through the upper PCB board, the upper cone-shape aluminum block and the lower PCB board, and a line tube which is respectively sleeved in said through-holes and mounted on the upper PCB board and the lower PCB board; a leading wire of the driver is passed through the through-holes to connect with electric pads of the upper PCB board; the LED lights on the upper PCB board and the lower PCB board are respectively received electricity from the upper PCB board and the lower PCB board.

3. A LED bulb according to claim 2, wherein an installed slot which is communicated with the inner chamber of the bottom portion of the lamp housing stand is formed in said pedestal corresponding to the through-holes.

4. A LED bulb according to claim 2, wherein the line hole of the lower cylinder-shape aluminum block is reamed to be a conical bore.

5. A LED bulb according to claim 4, wherein said support comprises a tube which is sleeved in the line hole, a cone flame which is located in the conical bore of lower cylinder-shape aluminum block, and a casing which is molded by the cone flame expanding along the radial direction and used for sleeving a top end of the driver.

6. A LED bulb according to claim 1, wherein an outer fastener is arranged on the opening of the lampshade, an inner slot is arranged on the inner side of the ring-shape groove of the lamp housing, and the outer fastener of the opening is snapped into the inner slot of ring-shape groove of the lamp housing.

7. A LED bulb according to claim 4, wherein a cone outer wall of the pedestal from a lower PCB board to the ring-shape groove concaved on the pedestal is mounted on a reflector which is coincided with the shape of the cone outer wall of pedestal, an end of reflector is bent perpendicularly to locate between the opening of the lampshade and the bottom of the ring-shape groove of the pedestal.

8. A LED bulb according to claim 1, wherein heat from the LED lights which are arranged on an upper PCB board and a lower PCB board is transferred to the lamp housing through an upper cone-shape aluminum block and a lower cylinder-shape aluminum block, and discharged outside via heat sinks which are protrudingly arranged on an outer wall of the lamp housing.

9. A LED bulb, comprising: a stand, wherein an end of the stand is shaped with a thread, and a driver which is sleeved in an inner chamber of the stand, wherein a lamp housing which comprises a T-like top portion and a bottom portion being arranged on the stand; wherein a sleeve is located on the bottom portion of lamp housing and sleeved on the stand; and a pedestal is formed by the top portion of lamp housing which is stretched protuberantly along the radial direction as a rotating track of a cone, wherein the pedestal includes a ring-shape groove is formed to communicate with an inner chamber of the bottom portion of the lamp housing in the concentric circle direction and to make an inner portion of a lampshade communicated with the outside, wherein a tube is formed on the top portion of the lamp housing in the center thereof and is communicated with the bottom portion of lamp housing, a caliber of the tube is smaller than the sleeve at the bottom portion of the lamp housing; and the lampshade is arranged on the top portion of the lamp housing and a opening of the lampshade is mounted on the ring-shape groove, wherein a T-like LED assembly is mounted on the tube of the top portion of lamp housing and the T-like LED assembly having a head that extends through the opening; the LED assembly includes an upper cone-shape aluminum block, a lower cylinder-shape aluminum block which is integrated with the upper cone-shape aluminum block and the diameter of the aluminum block being reduced, an upper PCB board which is arranged on an upper surface of the upper cone-shape aluminum block and has ring-shape LED lights arranged thereon, a lower PCB board which is covered on a lower surface of the upper cone-shape aluminum block and has ring-shape LED lights arranged thereon, a line hole along the circle center is respectively passed through the upper PCB board, the upper cone-shape aluminum block and lower cylinder-shape aluminum block, a support which is mounted in said line hole of the upper PCB LED board, the upper cone-shape aluminum block and the lower cylinder-shape aluminum block along the center line of said line hole to connect the stand and driver to the LED assembly through a fastening way, a through-hole which is symmetrically formed on both sides of the line hole and through the upper PCB board, the upper cone-shape aluminum block and the lower PCB board, and a line tube which is respectively sleeved in said through-holes and mounted on the upper PCB board and the lower PCB board; a leading wire of the driver is passed through the through-holes to connect with electric pads of the upper PCB board; the LED lights on the upper PCB board and the lower PCB board are respectively received electricity from the upper PCB board and the lower PCB board; an installed slot which is communicated with the inner chamber of the bottom portion of the lamp housing stand is formed in said pedestal corresponding to the through-holes; the line hole of the lower cylinder-shape aluminum block is reamed to be a conical bore; the support includes a tube which is sleeved in the line hole, a cone flame which is located in the conical bore of lower cylinder-shape aluminum block, and a casing which is molded by the cone flame expanding along the radial direction and used for sleeving a top end of the driver; an outer fastener is arranged on the opening of the lampshade, an inner slot is arranged on the inner side of the ring-shape groove of the lamp housing, and the outer fastener of the opening is snapped into the inner slot of ring-shape groove of the lamp housing; a cone outer wall of the pedestal from a lower PCB board to the ring-shape groove concaved on the pedestal is mounted on a reflector which is coincided with the shape of the cone outer wall of pedestal, an end of reflector is bent perpendicularly to locate between the opening of the lampshade and the bottom of the ring-shape groove of the pedestal; heat from the LED lights which are arranged on an upper PCB board and a lower PCB board is transferred to the lamp housing through an upper cone-shape aluminum block and a lower via cylinder-shape aluminum block, and discharged outside via heat sinks which are protrudingly arranged on an outer wall of the lamp housing.

* * * * *